United States Patent [19]

Schellenberg et al.

[11] Patent Number: 4,639,319

[45] Date of Patent: Jan. 27, 1987

[54] ELECTROLYTE STABILIZATION OF LATICES

[75] Inventors: Lutz Schellenberg, Cologne; Matthias Hamacher, Huerth-Gleul, both of Fed. Rep. of Germany; Bashir M. Ahmed, Ambler, Pa.

[73] Assignee: Gerhard Collardin GmbH, Cologne, Fed. Rep. of Germany

[21] Appl. No.: 757,597

[22] Filed: Jul. 22, 1985

[30] Foreign Application Priority Data

Aug. 25, 1984 [DE] Fed. Rep. of Germany ..... 3431276

[51] Int. Cl.[4] ..... B01D 13/00

[52] U.S. Cl. ..... 210/651; 210/321.1

[58] Field of Search ..... 210/644, 651, 652, 321.1, 210/321.2; 427/435

[56] References Cited

U.S. PATENT DOCUMENTS

| | | | |
|---|---|---|---|
| 2,049,828 | 8/1936 | Stevens | 210/644 X |
| 2,276,986 | 3/1942 | Kemp et al. | 210/644 X |
| 2,330,672 | 9/1943 | Braak | 210/644 X |
| 3,228,877 | 1/1966 | Mahon | 210/22 |
| 3,663,402 | 5/1972 | Christenson et al. | 204/181 |
| 4,529,521 | 7/1985 | Cortes et al. | 210/644 X |

FOREIGN PATENT DOCUMENTS

| | | | |
|---|---|---|---|
| 1266098 | 4/1968 | Fed. Rep. of Germany | 210/644 |

OTHER PUBLICATIONS

Porter et al., "Membrane Ultrafiltration", from *Chem. Tech.*, pp. 56–63, 1-1971.

*Primary Examiner*—Frank Spear

*Attorney, Agent, or Firm*—Ernest G. Szoke; Henry E. Millson, Jr.; Mark A. Greenfield

[57] ABSTRACT

A method for stabilizing the electrolyte content of latex composition baths in which, preferably, the bath is flowingly contacted with the outside of a tubular filtration membrane having pores smaller than the latex micelles, and partly deioized water flows through the center of the tubular membrane at a rate sufficient to cause a pressure differential and thus effect ultrafiltration removal of electrolytes.

19 Claims, No Drawings

ELECTROLYTE STABILIZATION OF LATICES

BACKGROUND OF THE INVENTION

1. Field of the Invention

The invention relates to a physical method for stabilizing the electrolyte content of latex compositions particularly the iron ion content of latex autodeposition baths.

2. Statement of the Related Art

The autodeposition process and autodeposition baths associated therewith (best known under the "Autophoretic" trademark of Amchem Products, Inc, Ambler, Pa. U.S.A.—a subsidiary of Henkel KGaA, Duesseldorf, Germany) is a process for pretreating and coating metal surfaces, particularly steel and iron surfaces, in which an acidic dispersion of an organic resin in water (i.e. a latex) containing pigments and auxiliaries is brought into contact with metal surfaces and, providing certain conditions are maintained, an organic coating is produced on those surfaces by a chemical reaction involving the substrate and the coating material. By virtue of its many advantages, this process is being used to an increasing extent in the metal-processing industry to impart effective protection against corrosion to metal parts, particularly to awkwardly situated metal parts. The autodeposition process (c.f. R. Morlock, "Jahrbuch Oberflachentechnik" 36, 327 (1980)) essentially comprises contacting metal surfaces, for example steel or iron surfaces, with an acidic aqueous dispersion containing resin-wetting agent or internally stabilized resin micelles. Under the corrosive attack of the acid on the iron surface, iron- (II) (i.e. ferrous) ions pass into solution, interacting with the negatively charged micelles and thus at least partly breaking down the negative charge by which the dispersion is stabilized. The dispersion coagulates at the dispersion/metal surface interface, resulting in the formation of a film adhering to the surface.

Unfortunately, more iron is generally dissolved by the corrosive reaction than is required for the equilibrium of the desired coating reaction. The excess iron ions accumulate in the coating bath and destabilize the latex. If certain limits are exceeded, the contents of the bath coagulate and the desired coating reaction can no longer take place.

Several attempts have been made to prevent this accumulation of excess ions and to stabilize the autodeposition bath at an optimum iron ion level. Thus, it is proposed in "Plaste und Kautschuk" 27:349 (1980) to add precipitants, particularly $Ca(OH)_2$, to the coating bath in order to precipitate the iron, oxidized to ferric by air or oxidizing agents, in the form of iron hydroxide. However, the disadvantage of adding calcium hydroxide to the coating bath is that other foreign ions (i.e. calcium) are introduced into the dispersion, in addition to which the acidity of the coating baths is undesirably displaced towards the alkaline range.

U.S. Pat. No. 3,791,431 discloses a process for autodeposition coating metal surfaces in which excess ferric iron ions are precipitated with phosphoric acid or alkali fluorides as phosphate or as complex fluorides or are complexed by additions of ethylene diamine tetraacetic acid (EDTA) or organic mono- or oligocarboxylic acids (citric acid, gluconic acid, tartaric acid or lactic acid) and thus removed from the solution or converted into a form which no longer gives rise to destabilization of the dispersions in the coating baths. The disadvantage of the additions described in the above patent is that certain pH-ranges which do not exactly coincide with the pH-value of the process have to be maintained for efficient precipitation or chelation. In addition, the deposits or complexes remain in the bath and partially redissolve when the pH-value is adjusted by the addition of hydrofluoric acid. Accordingly, the inorganic ions remaining in the bath solution continue to contribute towards destabilization of the dispersion. These disadvantages can only be partly offset by elaborate filtration processes.

U.S. Pat. No. 3,839,097 describes a process for stabilizing autodeposition baths, in which the baths, after the addition of surfactants, are passed over ion exchangers which are capable of removing the excess quantities of metal ions detrimental to the stability of the dispersions from the baths. This process is also apparatus-intensive, in addition to which the aqueous dispersions are inevitably impaired by pump-recirculation through the exchanger columns, so that a deterioration in the quality of the bath results.

Even an addition of dispersants and of a quantity of resin exceeding the concentration required for the formation of uninterrupted resin layers on the metal surface to the dispersion, as described in U.S. Pat. No. 3,936,546, could not satisfactorily eliminate the above disadvantages.

U.S. Pat. No. 4,414,350 discloses complexing the iron salts present in excess in an autodeposition bath, with at least one carboxylic acid such as acetic, succinic, acrylic, and the like. This process resulted in a sludge-laden bath.

More recently, as disclosed in copending U.S. patent application No. 06/725,470, which is assigned to a commonly owned company and whose disclosures relating to iron salt build-up are incorporated herein by reference, a method for bath stabilization (i.e. iron ion control) has been proposed in which one continuously or intermittently discards a predetermined volume of the bath, which volume is replaced by an equal volume of water, the discard rate being chosen so as to maintain a substantially constant concentration of iron salts in the bath. Independently of this, the other ingredients of the bath (latex, pigment, acid, etc.) are replenished at a rate sufficient to maintain each at its original concentration. The results of this method have been excellent with regard to both performance and stability. However, a considerable amount of latex and pigment is irretrievably lost, which increases the cost of the autodeposition process.

DESCRIPTION OF THE INVENTION

Other than in the operating examples, or where otherwise indicated, all numbers expressing quantities of ingredients, reaction conditions, or defining ingredient parameters used herein are to be understood as modified in all instances by the term "about".

The present invention provides a method by which it is possible to remove from acidic, aqueous baths containing organic coating materials, particularly from autodeposition baths, metal ions which adversely affect the stability of the latex dispersion and which are thus capable of permanently influencing the coating effect of the baths. The present invention also enables the troublesome metal ions to be removed from the baths using simple apparatus and without any need for additional measures, such as pump-circulation or filtration, because the shear forces acting on the bath solutions from such measures may also give rise to destabilization of the dispersion.

The present invention also may adjust the removal of excess metal ions from the aqueous coating baths by continuous monitoring of the electrolyte concentration of the baths. Thus, one only begins the separation of excess metal ions when their concentration in the autodeposition coating baths exceeds a value which involves the danger of destabilization of the latex dispersions. In this way, optimal provision is made for adaptation to the particular circumstances prevailing and the deposition of the resin layers on the metal surfaces, which is only possible in the presence of metal ions, is not affected.

The stabilization of the bath may thus be achieved either by intermittent reduction of excess electrolyte content when it exceeds a predetermined amount, by continuous incremental reduction, or both.

It has now surprisingly been found that the electrolyte (particularly iron) content of aqueous, acidic baths containing organic coating materials may readily be monitored by using filtration modules suitable for membrane filtration, for example for ultrafiltration or cross-flow microfiltration, for the selective separation of undesirable constituents of the coating bath. In this connection, allowance had to be made for the fact that, although it is possible in principle to remove troublesome iron and trace contaminant ions from the coating bath by ultrafiltration, the direct application of standard ultrafiltration techniques involves considerable problems because, in that process, (a) shear forces resulting in coagulation of the dispersions are generated by turbulent flows in the pumps and tube or plate membranes used, and (b) considerable pressure differences and high rates of flow occur which also have a destabilizing effect on the dispersion.

Accordingly, the present invention relates to a method for controlling and stabilizing the electrolyte content of aqueous resin dispersions by membrane filtration, using semipermeable filter modules having average pore diameters which substantially prevent passage of the organic components of the latex autodeposition baths. Generally, an autodeposition bath contains a latex (i.e. an aqueous resin dispersion with at least one surfactant), an optional pigment, and an activation system comprising a mineral acid (preferably hydrofluoric) and a water-soluble ferric salt (preferably ferric fluoride).

Optionally continuously, and using known measuring, regulating and/or metering instruments, at least partially deionized water flows through the filter modules in a separate closed circuit. It is a critical aspect of this invention that the at least partially deionized water flows through the passages or conduit within the filter module that is normally used for the feed. Thus, in a filter module useful in this invention, a form of diafiltration occurs, in which the autodeposition bath feed flows through the passages normally occupied by the filtrate (for which there must be an extra inlet/outlet), and the at least partially deionized water flows through the (usually larger) passages normally occupied by the feed. A hydrostatic pressure differential is generated across the membrane surfaces by suction or pumping of the water. Water, including the ions to be filtered off is removed from the latex bath up to a certain level and enriched in the aqueous recirculation phase. The loss of water and any desired ingredients from the autodeposition bath is replenished by addition of the respective ingredients.

In contrast to more common separation processes such as ultrafiltration, water (preferably fully deionized) and not the aqueous resin dispersion is pumped through the filter module. Accordingly, shear forces generated by the pumps and by the high pressures required for ultrafiltration, which can give rise to destabilization of the latex do not have an opportunity to act upon the latex.

The filter modules used are highly porous semipermeable microfiltration membranes, preferably in tube form, through which water flows from inside. The membrane material, which must be resistant to acids and alkalis throughout the entire pH-range and also to a number of organic solvents, may be any suitable material such as a polyolefin, for example polypropylene. It is preferred to use commercially available membranes which are produced in tube form and made up into filtration modules having semipermeable tube walls. The membranes are self-supporting and, without any supporting materials, withstand all the mechanical loads applied during filtration. However, the process according to the invention is not confined to tubular membranes and may also be carried out with membranes produced from the same materials, but in different geometric forms, for example in block, spiral, or cylindrical form or in the form of filter candles.

The tubular membranes for the filter modules have average pore diameters which should be sized small enough to prevent most latex (and pigment if present) particles from passing, and which preferably are smaller than the average micelle size of the organic components of the aqueous resin dispersions. This is necessary to prevent organic components of the aqueous resin dispersions from penetrating through the membrane surface. The average pore diameter is from $0.01\mu$ up to $0.2\mu$, preferably 0.1 to $0.17\mu$. Filter modules of which the membranes have this average pore diameter cannot easily become blocked by organic constituents of the aqueous resin dispersions. Bath constituents settling on the outer surface of the module may be conveniently removed by known backflushing techniques or may readily be rinsed off after the filter modules have been used. By contrast, it was found in state-of-the-art ultrafiltration processes that the latex dispersions were broken by the shear forces of the filtration process and a hard coagulate settled on the pressure side of the filter modules and could not be removed.

The shape and dimensions of the filter modules may vary within wide ranges. Although tubular modules are preferred, the filter modules may also be flat, rectangular, spiral, or other shapes, provided that they are capable of having at least partially deionized water flow through what would normally be the feed channel at a flow rate sufficient to generate the required pressure differential.

The length of the semipermeable tubular filter modules, which are preferably used, may be varied in dependence upon the volume of the aqueous dispersion bath in order to obtain efficient control of the electrolyte content. According to the invention, the tubular filter modules used should have a length of from 0.1 to 10 m per 10 l of bath volume and an internal diameter of from 0.05 to 1.0 cm.

The described tubular modules are immersed in the aqueous resin dispersions and connected at their ends to one or more separate containers containing at least partially, preferably fully, deionized water. One or more pumps are then connected to the filter module is such a way that a separate closed circuit is established between the feed water and the filter module. These pumps may be either suction or pressure pumps, so that the deionized water is either sucked in from the exit side of the module or pumped into the module from its entry side. Pressure pumping through the modules from the entry side must take place at flow rates which ensure that the resulting dynamic pressure is lower than the static pressure generated against the outer surface of the modules. This static pressure depends, inter alia, upon the depth to which the modules are immersed in the bath. A relatively high dynamic pressure would result in water passing from the closed circuit into the resin dispersion. Thus, in essence, the flow rate of the water should be sufficient to create a Venturi effect, without the pressure being so high that the water is forced outward through the filter membrane.

If relatively high filtration capacities are required, necessitating a relatively high rate of flow of the circulating water, the circulating water is advantageously sucked through the filter module, so that a pressure gradient sufficient for efficient separation of the metal ions is built up, without the possibility of a pressure build-up within the filter module.

The hydrostatic pressure prevailing in the center of the module decreases under the effect of the flow in the tubular filter module. Depending on the output of the pumps, the pressure differential between the outer membrane surface facing the aqueous resin dispersion and the inner surface rises to levels of 40 to 500 (preferably 300) mbar. For example, the pressure difference in a tubular filter module 290 cm long with an internal diameter of 0.5 cm is 47.4 mbar for a throughflow volume of 20 l/h, 200 mbar for a throughflow volume of 60 l/h and 410 mbar for a throughflow volume of 100 l/h.

In an effort to equalize this pressure difference, smaller molecular size constituents to which the membrane of the filter modules is permeable enter the interior of the modules from the acidic aqueous resin dispersion and are washed away by the stream of water. Smaller molecular size constituents of the dispersion which are able to pass through the membrane are, primarily, water and ions such as $Fe^{3+}$, $H^+$, $F^-$, $PO_4^{3-}$ and $SO_4^{2-}$. Relatively large molecular size constituents of the aqueous resin dispersions, such as resin-wetting agent micelles, do not pass through the membrane because, as mentioned above, the average pore diameter of the membranes used is smaller than the average micelle size of the resin dispersion to be treated.

In this way, water and ions dissolved in the aqueous phase are taken from the aqueous resin dispersion and enriched in the aqueous recirculation phase. The separation process may be continued until the ion content in the aqueous resin dispersion has reached the required level. For example, the content of ferric ions in aqueous resin dispersions which are to be used for autodeposition coating can fall to a level which neutralizes any destabilizing effect which the metal ions may have on the resin dispersion. This value amounts to between 1.5 and 4.5 g/l. The electrolyte content may be monitored by determining either the electrolyte value in the aqueous resin dispersion or the electrolyte value in the aqueous recirculation phase. In this connection, it is important to remember that the loss of water and desired electrolyte from the aqueous resin dispersion is made up to the required value by replenishment of the respective components, for example deionized water, a mineral acid such as hydrofluoric acid, etc.

The described process for controlling the electrolyte content of aqueous resin dispersions by membrane filtration is optionally carried out continuously using known measuring, regulating and/or metering instruments, or manually. This means that the content of unwanted ferric or other ions in the aqueous resin dispersion is continuously measured and the throughflow of fully deionized water through the tubular filter modules is controlled based on the result of that measurement.

The inventive process is preferably applied to latex dispersions which are used in the autodeposition process for which the ferric ion content must be kept below a certain threshold value so that the latex dispersions are not destabilized by metal ions nullifying the effect of useful surface-active substances, such as anionic and nonionic wetting agents. The content of bath constituents such as these is advantageously monitored without the addition of other ions which inevitable adversely affect the pH or other bath parameters, complicating or even preventing the desired formation of homogeneous protective layers on metal surfaces. In addition, the fact that it is not the latex or pigment of the coating bath but instead the activating substances which pass through the filter modules prevents mechanical forces from exerting a destabilizing effect on the latex in a simple and surprisingly efficient manner.

The invention is illustrated by the following examples.

EXAMPLE 1

A bath was used containing 30 l of an autodeposition coating system having the following composition:

- 5.4 kg of an anionic stabilized resin dispersion containing 33% of binder (latex)
- 1.5 kg of an acidic aqueous ferric fluoride solution (activator system)
- 23.1 kg of fully deionized water This bath contained 5.9% of binder, 1,698 ppm of iron and 0.2% of free fluoride. The pH of the bath was 2.9 and its conductivity 2,620 μS. The average micelle size of the dispersion used was 0.15 microns (μ) or $10^{-6}$ meter.

A tubular module of polypropylene having a maximum pore diameter of 0.17μ and a filter surface of 0.05 $m^2$ was immersed in the bath. The module membrane was a product of Membrana, Inc., whose U.S. offices are in Pleasanton, Calif. and Braintree, Mass., which is sold under the trademark "Accurel", and which is described by that company as a pure polypropylene membrane filter media containing no wetting agents, residual plasticizer or pore former (glycerol) and which is naturally hydrophobic.

2,080 g of fully deionized water were introduced into a separate vessel. A pump with an output of 6.2 l/h was connected to the module in such a way that a circuit was established between the vessel containing the fully deionized water and the module. The pump sucked the fully deionized water through the module. After a treatment time of 6.5 h, the fully deionized water initially introduced showed an increase in weight of 2,021 g. The conductivity rose from 6 μS to 1411 μS and the pH fell from 6.8 to 3.3. An iron content of 983 ppm was measured in the originally fully deionized water. In the coating bath, the iron content fell from 1,698 ppm to 1,508 ppm after the liquid loss had been made up with replenishment fully deionized water.

EXAMPLE 2

The coating bath described in Example 1 was operated in the same way with a pump output of 55.3 l/h. After 4.5 h, the increase in weight of the fully deionized water initially introduced amounted to 1714 g. An iron content of 849 ppm and an increase in conductivity from 5.3 μS to 1237 μS were measured in the fully deionized water initially introduced.

EXAMPLE 3

A bath containing 3 liters of coating material of the same composition, but with an iron content of 3,000 ppm, was operated in the same way as in Example 1 with a pump output of 64 l/h.

After a treatment time of 4 h, the increase in weight of the fully deionized water initially introduced amounted to 1,300 g. In the coating bath, the iron content fell from 3,000 ppm to 1.743 ppm after the liquid loss had been made up by the addition of fully deionized water.

The "Accurel" membrane used in the above examples is only exemplary and should not be taken as limiting. Thus, other tubular filtration membranes such as those manufactured by Abcor, Inc., Wilmington, Mass., U.S.A. (Abcor Division of Koch International GmbH, Duesseldorf, Germany) or still other manufacturers may also be employed. It should be noted, however, that these membranes are not used in the manner envisaged by the manufacturers, that is, with the feed flowing through the center. Quite to the contrary, when employed according to this invention, the membranes (perhaps without their housings) are immersed in the autodeposition bath while the at least partially deionized water flows through their centers. Essentially this is a reverse of the conventional filtrate flow.

We claim:

1. A method for stablizing the electrolyte content of acidic aqueous resin latex composition baths for autodeposition comprising:

introducing said latex composition into flowing contact with the outer surface of a filtration membrane whose pore size is at least small enough to prevent substantially all latex resin particles from passing through;

flowing at least partially deionized water along the inner surface of said filtration membrane in a closed circuit at a sufficient flow rate to generate a pressure differential of about 40 to 500 mbar between said membrane's outer and inner surfaces, thereby removing water and a portion of the soluble electrolytes from said latex composition and adding the same to said flowing at least partially deionized water; and replenishing a volume of deionized water to said bath equal to the volme removed by filtration.

2. The method of claim 1 wherein said filtration membrane comprises a tubular filtration module whose center is its inner membrane surface; and whose internal diameter is about 0.05 to 1.0 cm and length is about 0.1 to 10 m, per 10 liters of bath volume.

3. The method of claim 2 wherein the flow of said at least partially deionized water is caused by suction pump means after the exit end of said tubular module.

4. The method of claim 2 wherein the flow of said at least partially deionized water is caused by pressure pump means before the entrance of said tubular module.

5. The method of claim 1 wherein said membrane has an average pore size smaller than the average size of the resin micelles in said latex.

6. The method of claim 5 wherein said latex composition is an autodeposition bath containing at least a latex, an optional pigment, and an activator system comprising hydrofluoric acid and a water soluble ferric salt.

7. The method of claim 6 wherein the electrolyte content of said bath is stabilized to a ferric ion content of about 1.5 to 4.5 g/l.

8. The method of claim 7 wherein said stabilization is achieved by intermittent reduction of the ferric ion content when it exceeds a predetermined amount.

9. The method of claim 7 wherein said stabilization is achieved by continuous incremental reduction of the ferric ion content.

10. The method of claim 5 wherein said method is manually controlled.

11. The method of claim 5 wherein said method is automatically monitored and controlled.

12. The method of claim 5 wherein the average pore size of said membrane is about 0.01μ to 0.2μ in diameter.

13. The method of claim 5 wherein the average pore size of said membrane is about 0.1μ to 0.17μ in diameter.

14. The method of claim 5 wherein said flow rate generates a pressure differential of about 300 mbar.

15. The method of claim 5 wherein the flow of said at least partially deionized water is caused by suction pump means after the exit of said tubular module, said flow rate generates a pressure differential of about 300 mbar, and the average pore size of said membrane is about 0.1 to 0.17 μ in diameter.

16. The method of claim 1 wherein said latex composition is an autodeposition bath containing at least a latex, an optional pigment, and an activator system comprising hydrofluoric acid and a water soluble ferric salt.

17. The method of claim 16 wherein the electrolyte content of said bath is stabilized to a ferric ion content of about 1.5 to 4.5 g/l.

18. The method of claim 17 wherein said stabilization is achieved by intermittent reduction of the ferric ion content when it exceeds a predetermined amount.

19. The method of claim 17 wherein said stabilization is achieved by continuous incremental reduction of the ferric ion content.

* * * * *